US005721081A

United States Patent [19]

Takagi et al.

[11] Patent Number: 5,721,081

[45] Date of Patent: Feb. 24, 1998

[54] PHOTOCONDUCTOR FOR ELECTROPHOTOGRAPHY WITH ANTIOXIDANTS

[75] Inventors: Ikuo Takagi; Shigeru Maruyama, both of Kanagawa; Noboru Furusho, Nagano, all of Japan

[73] Assignee: Fuji Electric Co., Ltd., Kawasaki, Japan

[21] Appl. No.: 615,673

[22] Filed: Mar. 13, 1996

[30] Foreign Application Priority Data

Mar. 16, 1995 [JP] Japan ..... 7-057004

[51] Int. Cl.[6] ..... G03G 5/04

[52] U.S. Cl. ..... 430/59

[58] Field of Search ..... 430/58, 59, 66, 430/67

[56] References Cited

U.S. PATENT DOCUMENTS 4,563,408 1/1986 Lin et al. ..... 430/59

4,599,286 7/1986 Linnburg et al. ..... 430/59

5,292,603 3/1994 Sakai et al. ..... 430/58

*Primary Examiner*—John Goodrow

*Attorney, Agent, or Firm*—Morrison Law Firm

[57] ABSTRACT

A photoconductor for electrophotography with excellent resistance against oxidation has a charge transport layer which contains at least two kinds of oxidants and at least one charge transport material. The charge transport material is at least one selected from the group consisting of charge transport materials represented by general formulas (Ia) and (Ib). One oxidant is an antioxidant represented by general formula (II). The second oxidant is at least one selected from the group consisting of phenolic antioxidants, thioether antioxidants, phosphorus containing antioxidants excluding the triphenylphosphorus antioxidants, and amine antioxidants.

3 Claims, 1 Drawing Sheet

PHOTOCONDUCTOR FOR ELECTROPHOTOGRAPHY WITH ANTIOXIDANTS

BACKGROUND OF THE INVENTION

The present invention relates to photoconductors used in electrophotography. More specifically, the present invention relates to organic photoconductor laminates, used in electrophotographic printers, which comprise an organic charge generation layer and an organic charge transport layer.

Photoconductors for electrophotography generally have a laminate structure in which a photosensitive layer exhibiting photoconductivity (hereinafter referred to as "photoconductive layer") is laminated onto an electrically conductive substrate.

Among organic photoconductors that contain organic functional ingredients for charge generation and transport, laminate-type organic photoconductors, wherein functional layers that include a charge generation layer and a charge transport layer are laminated, facilitate the selection of their functional ingredients from a large variety of materials.

Recently, the laminate-type organic photoconductors have been widely applied to various printers because of their ease in function designing, their generally safe record, and their high productivity from their use of adoptable coating processes.

However, problems emerge from extended use over many hours of real world conditions. Such problems include a charge potential lowering, a remanent potential rise, and a lowered sensitivity when the laminate-type organic photoconductors are used for many hours in practice.

The problems may arise from external factors, such as ozone and strong light. Ozone is generated by the discharge and charging processes and strong light irradiation can come from the outside during routine maintenance.

The negative effects of these external factors can be determined experimentally by exposing the photoconductors to an ozone environment or by irradiating the photoconductors with various intensities of light.

Although various attempts have been made to try to solve the problems, such as the addition of various ingredients known as antioxidants or other ingredients known as ultraviolet light absorbers to the photoconductive layer have been made so far, no technique has been established as yet which produces all desired performances.

OBJECTS AND SUMMARY OF THE INVENTION

In view of the foregoing, it is an object of the present invention to provide a laminate-type organic photoconductor for electrophotography where the performance of the photoconductor is stabilized over a long period by optimum combinations of charge transport materials and antioxidants.

It is an object of the present invention to provide an organic photoconductor for electrophotography in which exposure to ozone or strong light does not cause fluctuations of electric potential or fluctuations in sensitivity.

It is an object of the present invention to provide an organic photoconductor for electrophotography where deterioration is prevented, of the organic materials contained in the photoconductive layer, which might be caused by oxidation by ozone produced during the charging process.

It is an object of the present invention to provide an organic photoconductor for electrophotography in which the optical deterioration is prevented, of the organic materials, which might be caused by exposure to strong external light during maintenance.

It is an object of the present invention to provide an organic photoconductor for electrophotography in which deterioration by oxidation is prevented by adding the antioxidants, represented by general formula (II) below, to the coating liquid for the charge transport layer.

It is an object of the present invention to provide an organic photoconductor for electrophotography in which deterioration is more effectively prevented from occurring by further adding other antioxidants.

It is an object of the present invention to provide an organic photoconductor for electrophotography in which, by using phthalocyanine pigments as the charge generation material, photoconductors adaptable to laser printers are obtained.

Briefly stated, the present invention provides a photoconductor for electrophotography with excellent resistance against oxidation has a charge transport layer which contains at least two oxidants and at least one charge transport material. The charge transport material is at least one selected from the group consisting of charge transport materials represented by general formulas (Ia) and (Ib). One oxidant is an antioxidant represented by general formula (II). The second oxidant is at least one selected from the group consisting of phenolic antioxidants, thioether antioxidants, phosphorus containing antioxidants excluding the triphenylphosphorus antioxidants, and amine antioxidants.

The present invention is a photoconductor for electrophotography comprising a conductive substrate, a charge generation layer on the conductive substrate, a charge transport layer on the charge generation layer, the charge transport layer containing at least one charge transport material selected from the group consisting of charge transport materials represented by general formulas (Ia) and (Ib) described below, wherein each of $R^1$, $R^2$, $R^3$, $R^4$, $R^5$, $R^6$, $R^7$, $R^8$ and $R^9$ represents a substituted or non-substituted aryl group, alkyl group or allylene group, Formula (Ia)

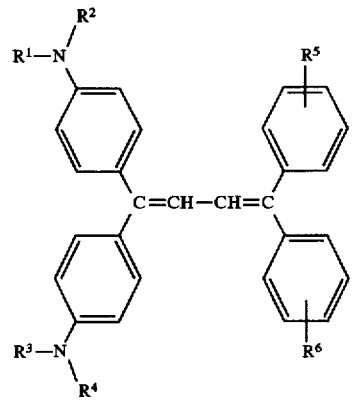

Formula (Ib)

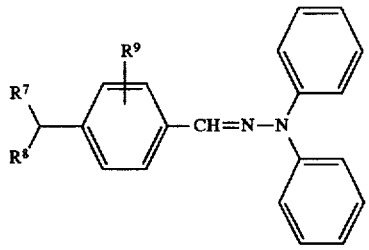

the charge transport layer further containing an antioxidant represented by general formula (II) described below, Formula (II)

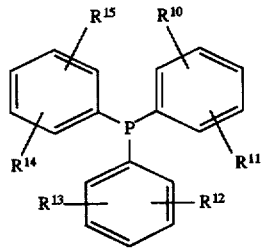

wherein each of $R^{10}$, $R^{11}$, $R^{12}$, $R^{13}$, $R^{14}$ and $R^{15}$ represents a hydrogen atom, halogen atom, hydroxyl group, amino group or alkyl group, and the charge transport layer further containing at least one antioxidant selected from the group consisting of phenolic antioxidants, thioether antioxidants, phosphorus containing antioxidants excluding triphenylphosphorus antioxidants, and amine antioxidants.

The present invention provides a charge transport layer for photoconductors for electrophotography comprising the charge transport layer comprising at least one charge transport material selected from the group consisting of charge transport materials represented by general formulas (Ia) and (Ib) described below, wherein each of $R^1$, $R^2$, $R^3$, $R^4$, $R^5$, $R^6$, $R^7$, $R^8$ and $R^9$ represents a substituted or non-substituted aryl group, alkyl group or allylene group;

Formula (Ia)

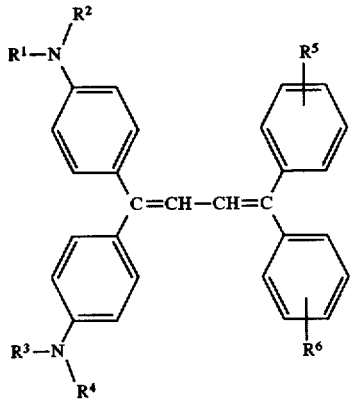

Formula (Ib)

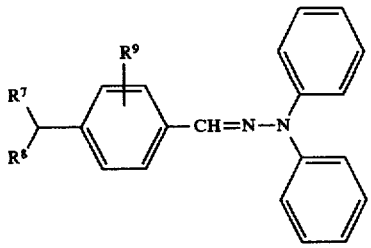

the charge transport layer further containing an antioxidant represented by general formula (II) described below, Formula (II)

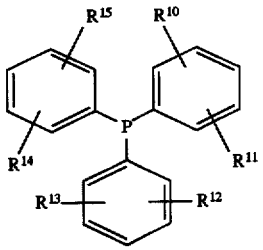

wherein each of $R^{10}$, $R^{11}$, $R^{12}$, $R^{13}$, $R^{14}$ and $R^{15}$ represents a hydrogen atom, halogen atom, hydroxyl group, amino group or alkyl group, and the charge transport layer further containing at least one antioxidant selected from the group consisting of phenolic antioxidants, thioether antioxidants, phosphorus containing antioxidants excluding triphenylphosphorus antioxidants, and amine antioxidants.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
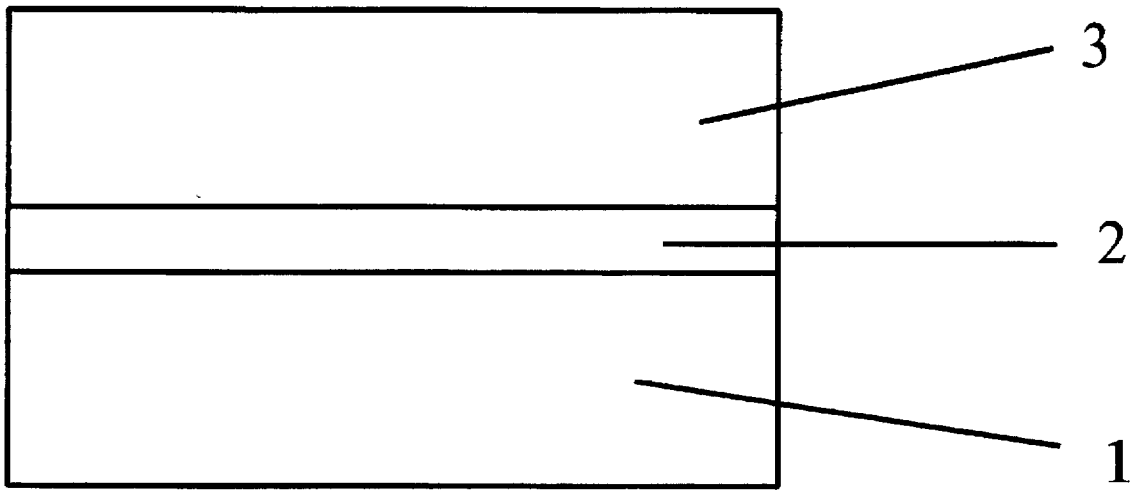
FIG. 1 is a cross section of a laminate-type photoconductor for electrophotography of the present invention.

According to the present invention, there is provided an organic photoconductor for electrophotography that includes a conductive substrate. A charge generation layer is on the conductive substrate, and a charge transport layer is on the charge generation layer.

The layers can be laminated, with the charge generation layer laminated on the conductive substrate and the charge transport layer laminated on the charge generation layer.

The charge transport layer contains at least one charge transport material selected from the group consisting of charge transport materials represented by general formulas (Ia) and (Ib) described below; an antioxidant represented by general formula (II) described below; and at least one antioxidant selected from the group consisting of phenolic antioxidants, thioether antioxidants, phosphorus containing antioxidants excluding triphenylphosphorus antioxidants, and amine antioxidants.

Formula (Ia)

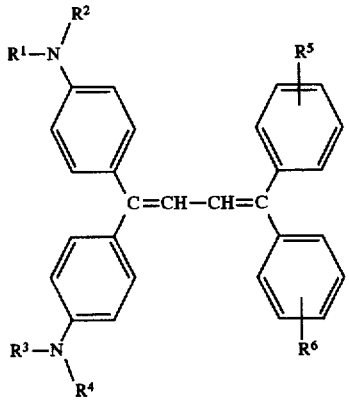

In general formula (Ia), each of $R^1$, $R^2$, $R^3$, $R^4$, $R^5$, and $R^6$ represents a substituted or non-substituted aryl group, alkyl group or allylene group.

Formula (Ib)

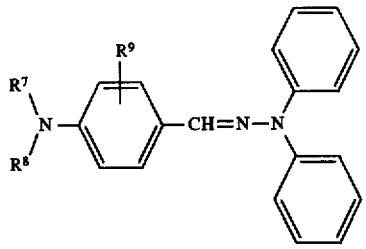

In general formula (Ib), each of $R^7$, $R^8$, and $R^9$ represents a substituted or non-substituted aryl group, alkyl group or allylene group.

Formula (II)

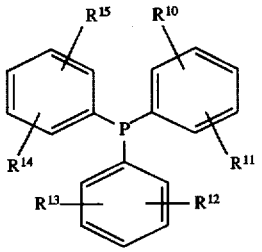

In general formula (II), each of $R^{10}$, $R^{11}$, $R^{12}$, $R^{13}$, $R^{14}$ and $R^{15}$ represents a hydrogen atom, halogen atom, hydroxyl group, amino group or alkyl group.

Advantageously, the charge generation layer contains a phthalocyanine pigment as the charge generation material.

Examples of the charge transport materials represented by general formulas (Ia) and (Ib) are described below, respectively, by chemical formulas (Ia-1) through (Ia-3) and (Ib-1) through (Ib-5).

Formula (Ia-1)

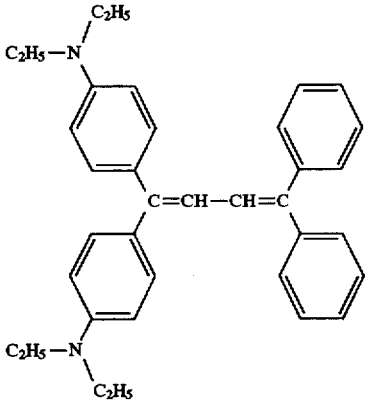

Formula (Ia-2)

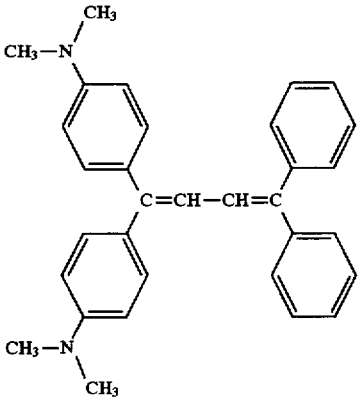

-continued

Formula (Ia-3)

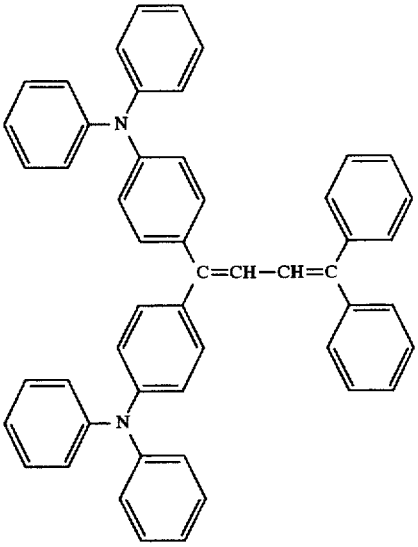

Formula (Ib-1)

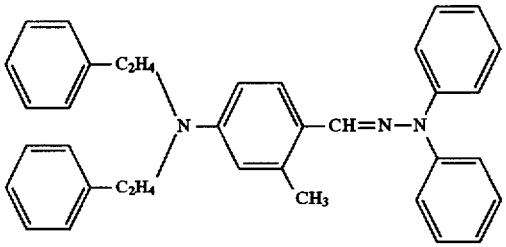

Formula (Ib-2)

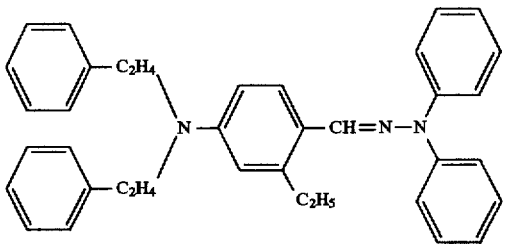

Formula (Ib-3)

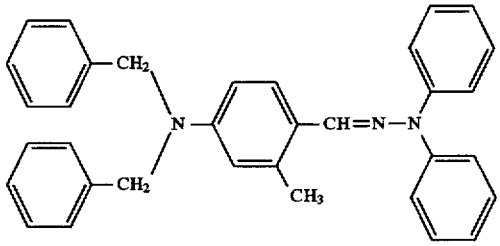

-continued

Formula (Ib-4)

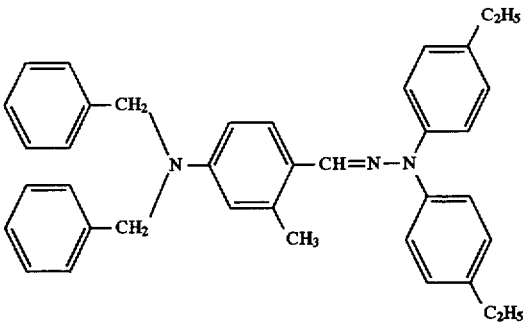

Formula (Ib-5)

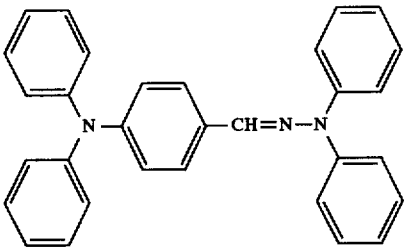

Examples of the antioxidants represented generally by formula (II) are described below by chemical formulas (II-1) through (I1-7).

Formula (II-1)

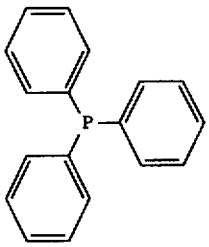

Formula (II-2)

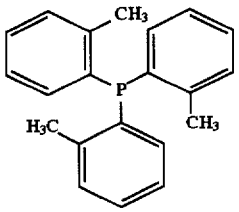

Formula (II-3)

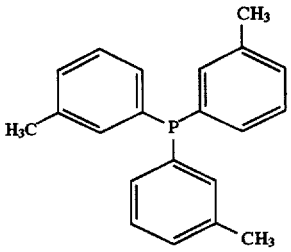

-continued

Formula (II-4)

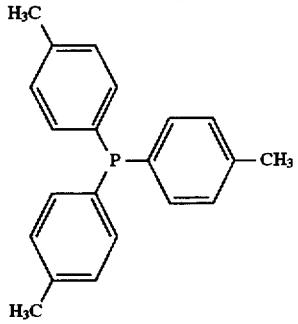

Formula (II-5)

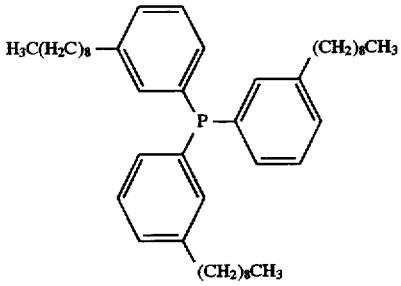

Formula (II-6)

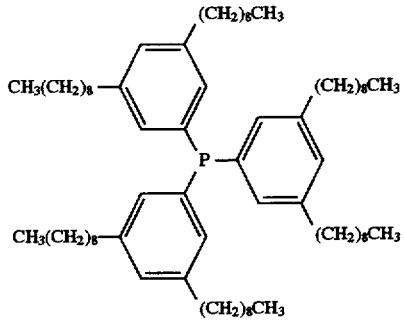

Formula (II-7)

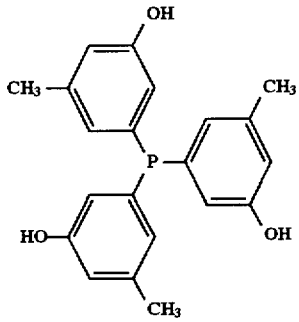

Examples of the phenolic antioxidants, the thioether antioxidants, the phosphorus containing antioxidants excluding triphenylphosphorus antioxidants, and the amine antioxidants are described below by chemical formulas (III-1) through (III-31), wherein "t-Bu" represents the $(CH_3)_3C$-group.

Formula (III-1)

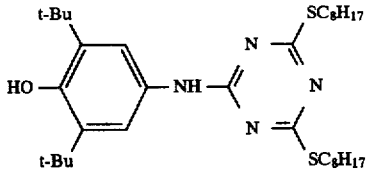

-continued
Formula (III-2)
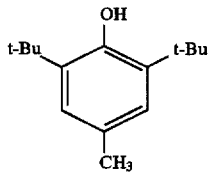
Formula (III-3)
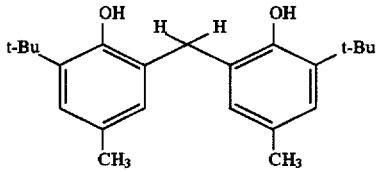
Formula (III-4)
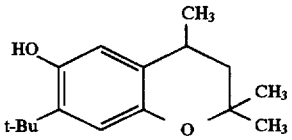
Formula (III-5)
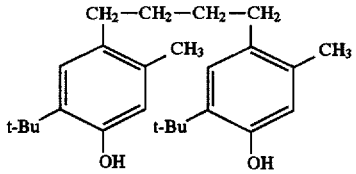
Formula (III-6)
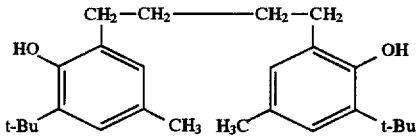
Formula (III-7)
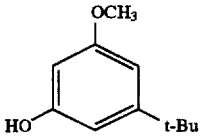
Formula (III-8)
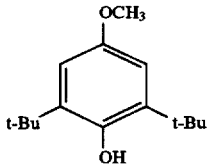
Formula (III-9)
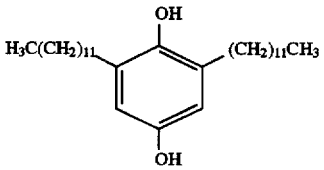
Formula (III-10)
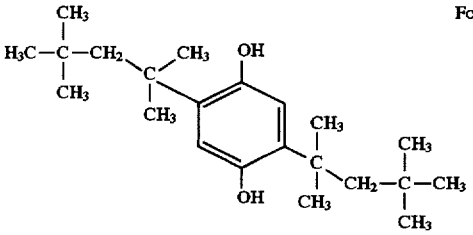
-continued
Formula (III-11)
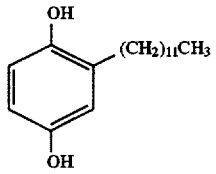
Formula (III-12)
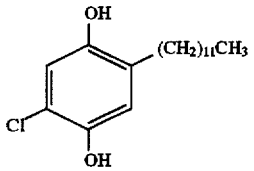
Formula (III-13)
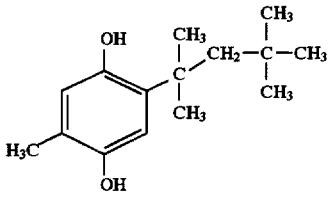
Formula (III-14)
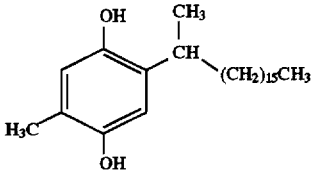
Formula (III-15)
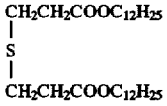
Formula (III-16)
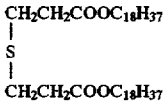
Formula (III-17)
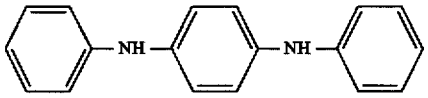
Formula (III-18)
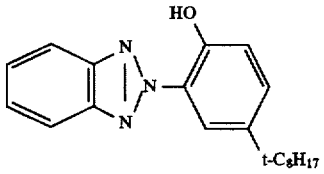
Formula (III-19)
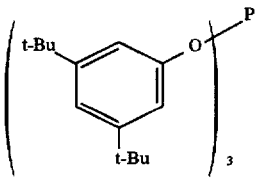

-continued
Formula (III-20)
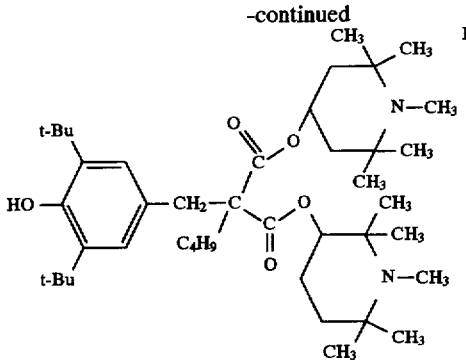
Formula (III-21)
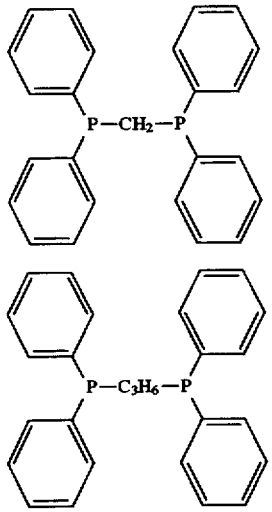
Formula (III-22)
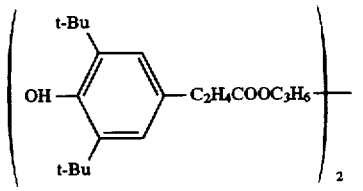
Formula (III-23)
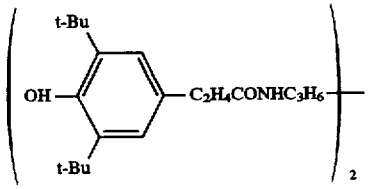
Formula (III-24)
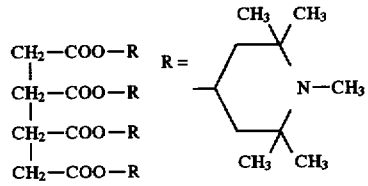
Formula (III-25)
Formula (III-26)
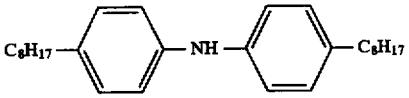
-continued
Formula (III-27)
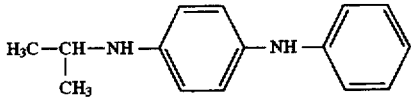
Formula (III-28)
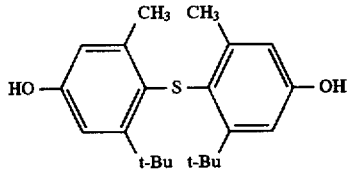
Formula (III-29)
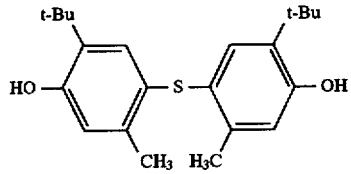
Formula (III-30)
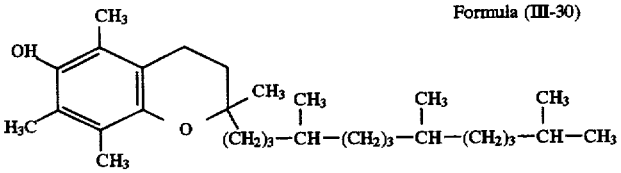
Formula (III-31)
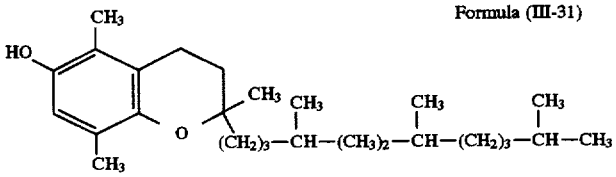
Examples of the phthalocyanine pigments are described below by chemical formulas (IV-1) through (IV-6).
Formula (IV-1)
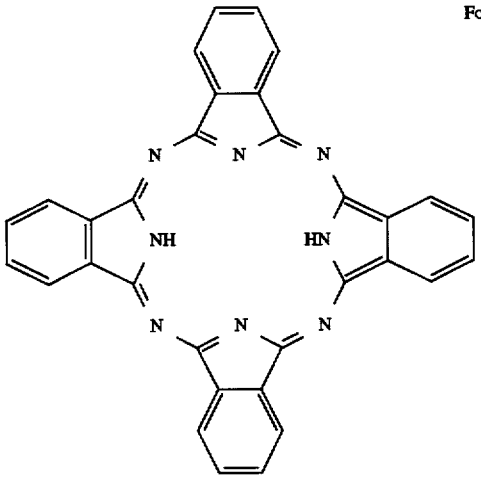

-continued

Formula (IV-2)

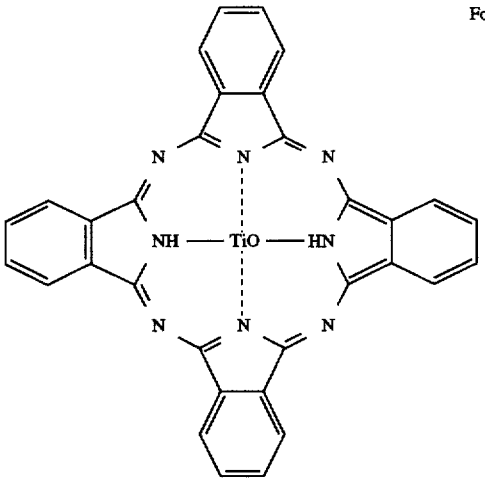

Formula (IV-3)

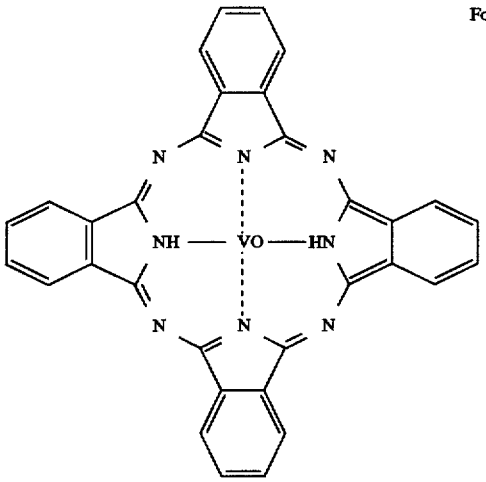

Formula (IV-4)

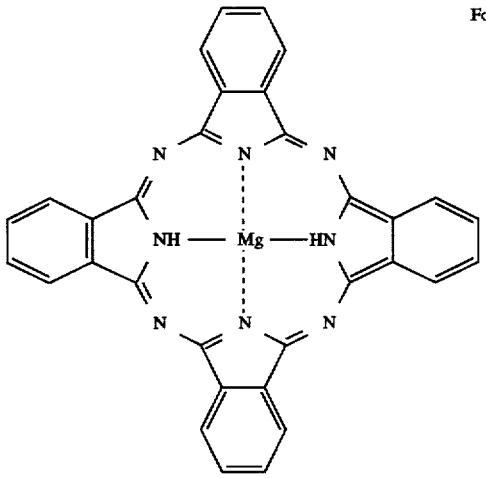

-continued

Formula (IV-5)

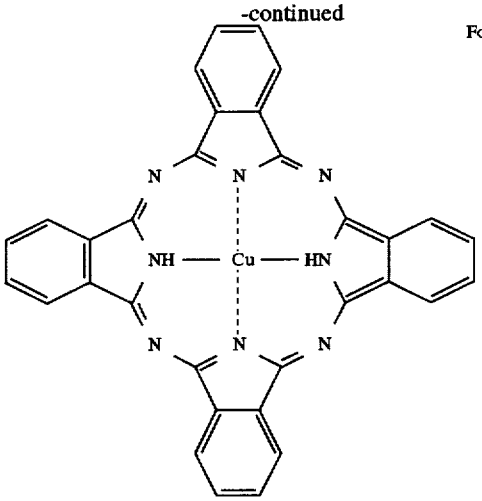

Formula (IV-6)

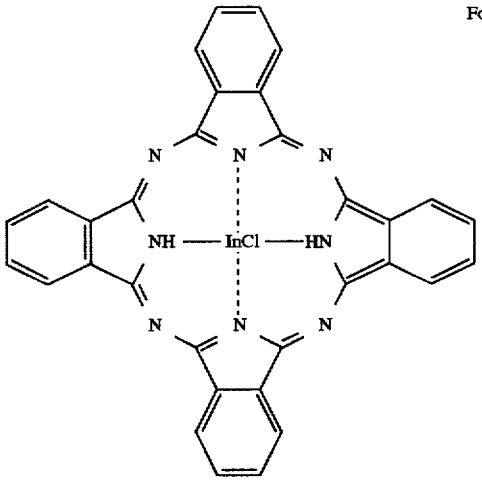

Exposure to ozone or strong light does not cause fluctuations of electric potential or fluctuations in sensitivity of the photoconductors fabricated according to the present invention. Further, no deterioration with age is observed in the potential and sensitivity characteristics of the photoconductors of the invention used in actual electrophotographic apparatuses for many hours.

The photoconductor of the present invention prevents the deterioration of the organic materials contained in the photoconductive layer which might be caused by oxidation by ozone produced during the charging process.

The photoconductor of the invention also prevents the optical deterioration of the organic materials which might be caused by exposure to strong external light during maintenance.

It is effective for suppressing deterioration by oxidation to add the antioxidants represented by general formula (II) to the coating liquid for the charge transport layer. Deterioration is more effectively prevented from occurring by further adding the other antioxidants. By using phthalocyanine pigments as the charge generation material, photoconductors adaptable to laser printers are obtained.

The present invention will be explained in detail hereinafter in connection with the preferred embodiments.

FIG. 1 is a cross section of a laminate-type photoconductor for electrophotography to which the present invention is applied. In FIG. 1, the photoconductor comprises a substrate 1, a charge generation layer 2, and a charge transport layer 3.

A cylindrical aluminum tube and a film on which aluminum is deposited are used for the substrate. Alternatively, a conductive substrate, the surface of which is coated with anodized alumina or a resin film, is used.

In the embodiments of the present invention, cylindrical aluminum tubes 1 mm in thickness, 310 mm in length and 60 mm in outer diameter are used as the substrates. The cylindrical substrates are cleaned and dried, and the surface of the substrates have a coating film in which polymer is dispersed.

Materials for the coating film include insulating polymers such as casein, poly(vinyl alcohol), nylon, polyamide, melanin, or cellulose. Also included are conductive polymer such as polythiophene, polypyrrole, or polyaniline. Further included are the previous polymers with metal oxide powder or a low molecular weight compound added.

The charge generation layer contains a charge generation material and a resin binder. The phthalocyanine compounds represented by chemical formulas (IV-1) through (IV-6) are used as the charge generation material. Used as the binder for the charge generation layer are polycarbonate, polyester, polyamide, polyurethane, epoxypoly(vinyl butyral), poly (vinyl acetal), phenoxy resin, silicone resin, acrylic resin, vinyl chloride resin, vinylidene chloride resin, vinyl acetate resin, formal resin, and cellulose resin. Copolymers, halogenides, and cyanoethyl compounds of these resins are also used.

The charge transport layer comprises a charge transport material and a resin binder. Compounds represented by chemical formulas (Ia-1) through (Ia-3) and their derivatives, and compounds represented by chemical formulas (Ib-1) through (Ib-5) and their derivatives are used in combination for the charge transport material.

The compounds represented by chemical formulas (II-1) through (II-7) are used as an additive added to the coating liquid for the charge transport layer. The antioxidants represented by chemical formulas (III-1) through (III-31) are used as an additional antioxidant. Bisphenol A polycarbonate, polycarbonate Z, polystyrene, poly (phenylene ether) acrylic resin, etc. are used as the binder resin for the charge transport layer. Especially, bisphenol A-bisphenyl polycarbonate copolymer is remarkable as the antioxidant.

First embodiment

A resin coating liquid was prepared by dissolving 4 parts by weight of polyamide with average molecular weight of one hundred thousand (Diamid T-171 supplied from Daicel-Hules) and 1 part by weight of styrene-maleic acid resin (SUPRAPAL AP supplied from BASF Japan Ltd.) into a mixed solvent of 200 parts by weight of methanol and 100 parts by weight of 1-butanol. Then, a resin film coat was formed on the above described cylindrical substrate to a thickness of 0.1 μm by dipping the substrate in the coating liquid.

A coating liquid for the charge generation layer was prepared by mixing 5 parts by weight of metal-free phthalocyanine represented by chemical formula (IV-1) as a charge generation material, 5 parts by weight of poly (vinylacetal) (S-LEC KS-1 supplied from Sekisui Chemical Co., Ltd.) as a binder resin and 700 parts by weight of dichloromethane for 3 hrs in a kneading machine.

A coating liquid for the charge transport layer was prepared by dissolving 500 parts by weight the compound represented by chemical formula (Ia-1), 500 parts by weight the compound represented by chemical formula (Ib-1), 1000 parts by weight of bisphenol A-bisphenyl polycarbonate copolymer (BP-Pc supplied from IDEMITSU KOSAN CO., LTD.), 2 parts by weight of the compound represented by chemical formula (II-2), and 20 parts by weight of the compound represented by chemical formula (III-30) into 7000 parts by weight of dichloromethane.

The charge generation layer and charge transport layer were formed on the above described substrate by dipping the substrate in the thus prepared coating liquids to fabricate a photoconductor.

Second embodiment

The second photoconductor was fabricated in the similar manner as in the first embodiment except the charge transport material of chemical formula (Ia-3) was used in the second embodiment in place of the charge transport material of chemical formula (Ia-1) used in the first embodiment.

Third embodiment

The third photoconductor was fabricated in the similar manner as in the first embodiment except the charge transport material of chemical formula (Ib-2) was used in the third embodiment in place of the charge transport material of chemical formula (Ib-1) used in the first embodiment.

Fourth embodiment

The fourth photoconductor was fabricated in the similar manner as in the first embodiment except the compound of chemical formula (II-1) was used in the fourth embodiment in place of the compound of chemical formula (II-2) used in the first embodiment.

Fifth embodiment

The fifth photoconductor was fabricated in the similar manner as in the first embodiment except the compounds of chemical formulas (II-1) and (III-2) were used in the fifth embodiment in place of the compounds of chemical formulas (II-2) and (III-30) used respectively in the first embodiment.

Sixth embodiment

The sixth photoconductor was fabricated in the similar manner as in the first embodiment except the compounds of chemical formulas (II-3) and (III-2) were used in the sixth embodiment in place of the compounds of chemical formulas (II-2) and (III-30), respectively, used in the first embodiment.

Seventh embodiment

The seventh photoconductor was fabricated in the similar manner as in the first embodiment except 1000 parts by weight of bisphenyl Z polycarbonate (PCZ300 supplied from MITSUBISHI GAS CHEMICAL CO., INC.) was used for a resin binder in place of 1000 parts by weight of type hisphenol A-bisphenyl polycarbonate copolymer (BP-Pc supplied from IDEMITSU KOSAN CO.,LTD.) of the first embodiment.

Eighth embodiment

The eighth photoconductor was fabricated in the similar manner as in the first embodiment except 1000 parts by weight of bisphenol A polycarbonate (Panlite L-1225 supplied from TEIJIN LTD.) was used for a resin binder in place of 1000 parts by weight of bisphenol A-bisphenyl polycarbonate copolymer (BP-Pc supplied from IDEMITSU KOSAN CO., LTD.) of the first embodiment.

Comparative Example 1

A comparative photoconductor was fabricated in the similar manner as in the first embodiment except that the compounds of chemical formulas (II-2) and (III-30) were not mixed in the coating liquid for the charge transport layer of the comparative example 1.

Comparative Example 2

A comparative photoconductor was fabricated in the similar manner as in the first embodiment except that the compound of chemical formulas (II-2) was not mixed in the coating liquid for the charge transport layer of the comparative example 2.

Comparative Example 3

A comparative photoconductor was fabricated in the similar manner as in the first embodiment except that the compound of chemical formulas (III-30) was not mixed in the coating liquid for the charge transport layer of the comparative example 3.

Comparative Example 4

A comparative photoconductor was fabricated in the similar manner as in the second embodiment except that the compound of chemical formulas (II-2) was not mixed in the coating liquid for the charge transport layer of the comparative example 4.

Comparative Example 5

A comparative photoconductor was fabricated in the similar manner as in the second embodiment except that the compound of chemical formulas (III-30) was not mixed in the coating liquid for the charge transport layer of the comparative example 5.

Comparative Example 6

A comparative photoconductor was fabricated in the similar manner as in the seventh embodiment except that the compound of chemical formulas (II-2) was not mixed in the coating liquid for the charge transport layer of the comparative example 6.

Comparative Example 7

A comparative photoconductor was fabricated in the similar manner as in the eighth embodiment except that the compound of chemical formulas (III-30) was not mixed in the coating liquid for the charge transport layer of the comparative example 7.

Electrophotographic properties of the embodied and the comparative photoconductors were evaluated. For evaluating potential variations during continuous use of the photoconductors, running tests were conducted for fifty thousand sheets of A3 size paper in an environment of ordinary temperature and ordinary humidity (20° C. and 60 RH).

Bright potential (Vw) and dark potential (Vb) were compared at the start and end of the running test. And, for evaluating resistance of each photoconductor against ozone, the photoconductors were exposed for 4 hrs in an environment, the ozone concentration therein was kept at 100 ppm, and half-decay exposure light intensities were measured and compared before and after the exposure.

Furthermore, for evaluating fatigue resistance against strong light, each photoconductor was exposed for an hour under a predetermined charging condition, and initial charge potential (Vs) and charge potential (Vs) after the exposure were compared. Results are listed in Table 1.

TABLE 1

| | Results of running test | | | | Results of exposure to ozone Half decay exposure light intensity | | Result of strong light irradiation | |
|---|---|---|---|---|---|---|---|---|
| | Initial potential | | Resultant potential | | Before exposure | After exposure | Initial potential | Resultant potential |
| Specimens | Vw (V) | Vb (V) | Vw (V) | Vb (V) | (μJ/cm²) | | Vs (V) | Vs (V) |
| 1st. Embodiment | −41 | −630 | −61 | −620 | 0.43 | 0.44 | −647 | −637 |
| 2nd. Embodiment | −44 | −625 | −67 | −614 | 0.42 | 0.43 | −640 | −630 |
| 3rd. Embodiment | −42 | −636 | −68 | −626 | 0.42 | 0.45 | −645 | −636 |
| 4th. Embodiment | −41 | −630 | −85 | −620 | 0.44 | 0.46 | −642 | −620 |
| 5th. Embodiment | −43 | −631 | −87 | −610 | 0.43 | 0.44 | −643 | −618 |
| 6th. Embodiment | −42 | −625 | −85 | −611 | 0.45 | 0.48 | −645 | −619 |
| 7th. Embodiment | −51 | −630 | −95 | −602 | 0.46 | 0.48 | −642 | −609 |
| 8th. Embodiment | −46 | −635 | −93 | −603 | 0.47 | 0.49 | −645 | −611 |
| Comparative 1 | −44 | −610 | −120 | −499 | 0.41 | 0.55 | −651 | −511 |
| Comparative 2 | −46 | −616 | −103 | −545 | 0.42 | 0.53 | −642 | −570 |
| Comparative 3 | −53 | −633 | −120 | −520 | 0.41 | 0.54 | −644 | −564 |
| Comparative 4 | −56 | −621 | −118 | −523 | 0.43 | 0.55 | −647 | −559 |
| Comparative 5 | −48 | −619 | −95 | −500 | 0.45 | 0.56 | −641 | −578 |

TABLE 1-continued

| Specimens | Results of running test: Initial potential Vw (V) | Initial potential Vb (V) | Resultant potential Vw (V) | Resultant potential Vb (V) | Results of exposure to ozone Half decay exposure light intensity Before exposure (μJ/cm²) | After exposure (μJ/cm²) | Result of strong light irradiation: Initial potential Vs (V) | Resultant potential Vs (V) |
|---|---|---|---|---|---|---|---|---|
| Comparative 6 | −51 | −630 | −140 | −498 | 0.43 | 0.61 | −648 | −528 |
| Comparative 7 | −53 | −638 | −130 | −487 | 0.47 | 0.62 | −643 | −522 |

As Table 1 clearly indicates, the properties of the photoconductors, which do not contain any compounds of general formula (II) and any extra antioxidants, are deteriorated drastically by exposure to ozone or strong light irradiation. Further, the potential of these photoconductors varies so widely during the running test in a practical machine that the photoconductors which do not contain any compounds of general formula (II) and any extra antioxidants are useless for any practical electrophotographic apparatus.

In contrast, especially in the first, second, and third embodiments, which contain the compound of chemical formula (II-2) and the phenolic antioxidant of chemical formula (III-30), bright potential variations determined in the running test and charge potential variations caused by strong light irradiation are suppressed within a narrow range. Further, as the results of the first, seventh and eighth embodiments indicate, the photoconductors of the present invention exhibit extremely advantageous stability when bisphenol A-bisphenyl polycarbonate copolymer is used as the resin binder.

The photoconductor of the present invention contains at least one charge transport material selected from the group consisting of charge transport materials represented by general formulas (Ia) and (Ib); an antioxidant represented by general formula (II); and at least one antioxidant selected from the group consisting of phenolic antioxidants, thioether antioxidants, phosphorus containing antioxidants excluding triphenylphosphorus antioxidants, and amine antioxidants.

The photoconductor of the present invention exhibits stable properties during continuous use for many hours which are not deteriorated by exposure to ozone or by strong light irradiation. The properties of the photoconductor of the present invention are further stabilized for use in laser printers by phthalocyanine pigments contained in the charge transport layer as the charge transport material.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A photoconductor for electrophotography comprising:

a conductive substrate;

a charge generation layer on said conductive substrate;

a charge transport layer on said charge generation layer;

said charge transport layer containing at least one charge transport material selected from the group consisting of charge transport materials represented by general formulas (Ia) and (Ib) described below, wherein each of $R^1$, $R^2$, $R^3$, $R^4$, $R^5$, $R^6$, $R^7$, $R^8$ and $R^9$ represents a substituted or non-substituted aryl group, alkyl group or allylene group;

Formula (Ia)

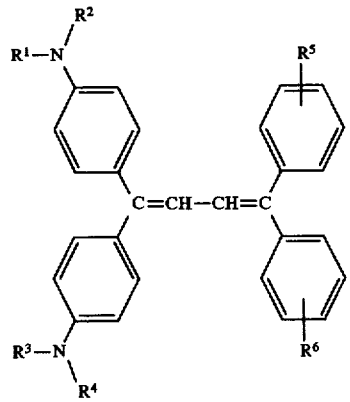

Formula (Ib)

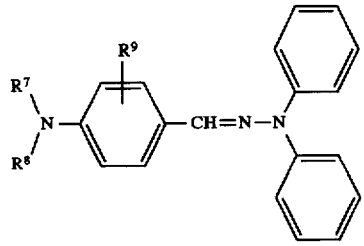

said charge transport layer further containing an antioxidant represented by general formula (II) described below, Formula (II)

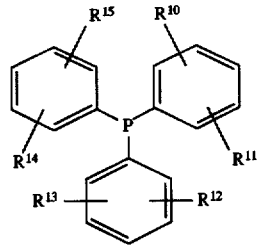

wherein each of $R^{10}$, $R^{11}$, $R^{12}$, $R^{13}$, $R^{14}$ and $R^{15}$ represents a hydrogen atom, halogen atom, hydroxyl group, amino group or alkyl group; and said charge transport layer further containing at least one antioxidant selected from the group consisting of phenolic antioxidants, thioether antioxidants, phosphorus containing antioxidants excluding triphenylphosphorus antioxidants, and amine antioxidants.

2. The photoconductor for electrophotography of claim 1, wherein said charge generation layer contains a phthalocyanine pigment as the charge generation material.

3. A charge transport layer for photoconductors for electrophotography comprising:

said charge transport layer comprising at least one charge transport material selected from the group consisting of charge transport materials represented by general formulas (Ia) and (Ib) described below, wherein each of $R^1$, $R^2$, $R^3$, $R^4$, $R^5$, $R^6$, $R^7$, $R^8$ and $R^9$ represents a substituted or non-substituted aryl group, alkyl group or allylene group;

Formula (Ia)

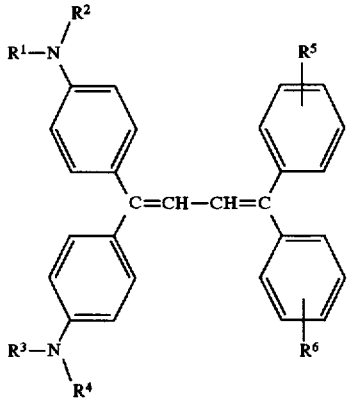

-continued

Formula (Ib)

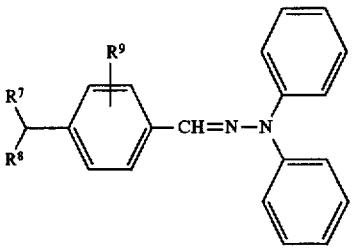

said charge transport layer further containing an antioxidant represented by general formula (II) described below, Formula (II)

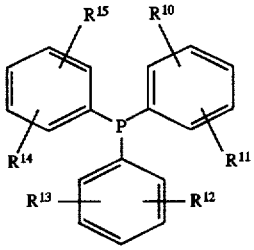

wherein each of $R^{10}$, $R^{11}$, $R^{12}$, $R^{13}$, $R^{14}$ and $R^{15}$ represents a hydrogen atom, halogen atom, hydroxyl group, amino group or alkyl group; and said charge transport layer further containing at least one antioxidant selected from the group consisting of phenolic antioxidants, thioether antioxidants, phosphorus containing antioxidants excluding triphenylphosphorus antioxidants, and amine antioxidants.

* * * * *